United States Patent [19]

Gil

[11] Patent Number: 4,892,493

[45] Date of Patent: Jan. 9, 1990

[54] SUPPLEMENTAL SAILBOAT PROPULSION DEVICE

[76] Inventor: Yoram Gil, 1441 S. Beverly Glen Rd., Los Angeles, Calif. 90024

[21] Appl. No.: 250,742

[22] Filed: Sep. 29, 1988

[51] Int. Cl.[4] ..... B63H 16/08

[52] U.S. Cl. ..... 440/17; 114/132; 440/21

[58] Field of Search ..... 114/140, 143, 141, 132; 440/13, 17, 19, 20, 21

[56] References Cited

U.S. PATENT DOCUMENTS

| | | | |
|---|---|---|---|
| 817,810 | 4/1906 | Sheen | 440/19 |
| 1,204,937 | 11/1916 | Carley | 440/19 |
| 1,324,397 | 12/1919 | Hobart | 440/17 X |

*Primary Examiner*—Sherman D. Basinger
*Attorney, Agent, or Firm*—Philip D. Junkins

[57] ABSTRACT

A supplemental propulsion device for a sailboat or sailboard type water craft including a pivotal centerboard. A pair of propulsion wings that are vertically hinged to one-another and mounted to the lower portion of the leading edge of the centerboard of the craft. Upon the application to the centerboard of a reciprocating pumping action each propulsion wing moves inwardly to a retracted position adjacent the centerboard during forward movement of the lower portion of the centerboard and moves outwardly to an extended position removed from the centerboard during rearward movement of the lower portion of the centerboard. Cables connect the free edge of each of the propulsion wings to the trailing edge of the centerboard to stop the outwardly movement of the wings at a point no more than 90° from the centerboard during the rearward movement of the lower portion of the centerboard whereby the propulsion wings provide enlarged and effective surfaces to the surrounding water to forcefully propel the craft through the water.

2 Claims, 1 Drawing Sheet

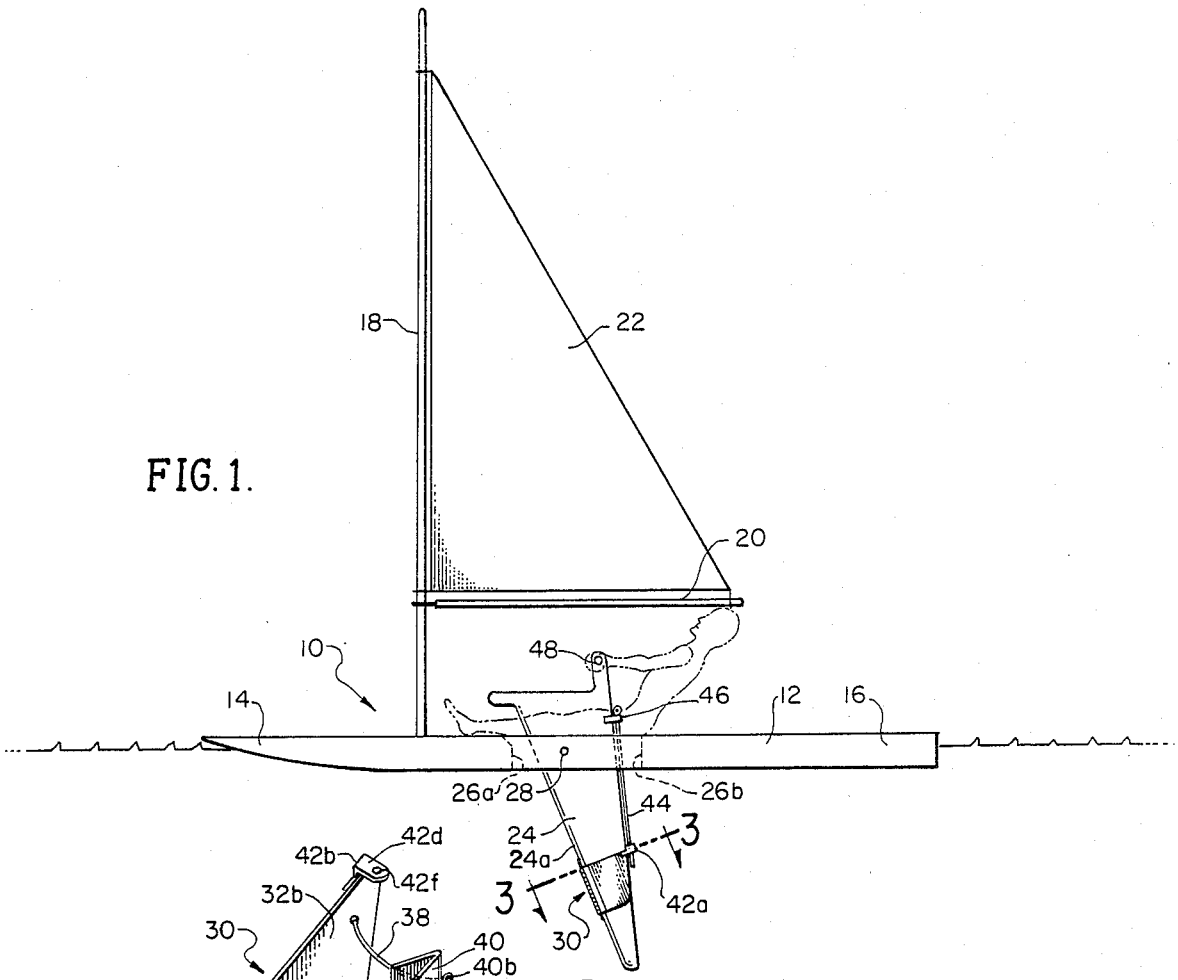
FIG. 1.
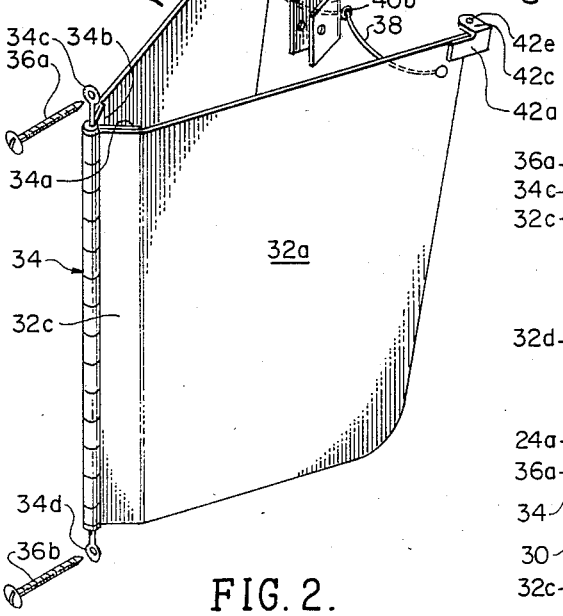
FIG. 2.
FIG. 3.
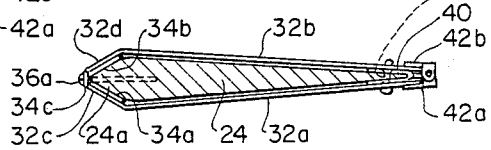
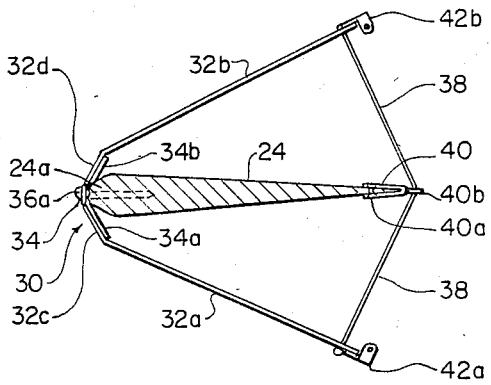
FIG. 4.

SUPPLEMENTAL SAILBOAT PROPULSION DEVICE

FIELD OF THE INVENTION

This invention relates to a device to be used as a supplemental or emergency means for propelling a sailboat or other water craft that is without movement power. More particularly, the invention relates to supplemental or emergency propulsion means for use in connection with sailboats or sailboards which have a pivotal or removable centerboard.

BACKGROUND OF THE INVENTION

For many years there has been a developing interest in the recreational use of small sailboats (accommodating 1–4 passengers) and sailboards (usually accommodate 1–2 riders). Many of such sailboats (particularly those with shallow draft) and sailboards (with literally no draft) are stabilized in the water when under sail against sudden or radical side tipping by centerboards. Centerboards extend downwardly through a longitudinal slot in the hull or body of the boat or sailboard and, beacause such water crafts are most frequently portable (capable of being carried or are trailerable), they may be detachably or pivotally mounted within the hull slot.

In the field of recreational sailboats and sailboards it sometimes occurs that a sail or mast is lost or destroyed or there is a lack of wind power for propelling the boat or board. Under such circumstances it frequently becomes necessary for the sailor and/or a passenger (if any) to row the boat to shore by a pair of single-bladed oars pivoted to side oarlocks or to paddle the sailboard to shore by a double bladed paddle.

It is an object of the present invention to provide a water propulsion device for sailboats and sailboards which is mountable to the centerboard of such boats and boards.

It is another obJect of the invention to provide a water propulsion device mountable to the centerboard of a sailboat or sailboard for use in propelling such boat or sailboard during periods when wind propulsion is not available or when a sail or mast is damaged and wind power can not be utilized.

It is a still further obJect of the invention to provide an emergency water propulsion device for sailboats and sailboards which is readily mountable to the centerboard of such water crafts and which does not interfere with the functioning of the centerboard during normal wind sailing procedures.

Other objects and advantages of the invention will become apparent from the following summary and detailed description of preferred embodiments of the invention taken in conJunction with the accompanying drawing figures.

SUMMARY OF THE INVENTION

The present invention relates to a supplemental propulsion device for sailboats and sailboards which is mountable to the leading edge of the centerboard of such water crafts. The centerboards of small sailboats and sailboards extend downwardly below these crafts for stabilization purposes and extend upwardly through a hull slot and are either pivoted to the boat or board hull or are removably affixed in pivotal fashion to the hull. The propulsion device of the invention comprises a pair of propulsion wings which are vertically hinged to one-another with the wing hinge mounted to the leading edge of the centerboard. By reciprocating the centerboard at its upper end forwardly and rearwardly about its pivot point the propulsion wings are positioned outwardly during the push or thrust portion of the reciprocating cycle and are positioned inwardly adJacent the sides of the centerboard during the pull portion of the reciprocating cycle of the centerboard. During periods of wind sailing, when the propulsion device of the invention is not in use, the wings of the device are locked into closed position inwardly adJacent the sides of the centerboard.

For assisting the sailor or passenger in utilization of the propulsion device of the invention, the centerboard has at its upper end a handle by which the centerboard (upon release from its fixed stabilizing position) may be pumped or reciprocated. Such handle may be positioned forward or rearward of the pivot point of the centerboard so that the person pumping the centerboard, and thus the propulsion device, may be seated in centerboard-straddling position facing forward toward the bow (front) or rearward toward the stern (rear) of the sailboat or sailboard.

BRIEF DESCRIPTION OF THE DRAWING FIGURES

FIG. 1 is a side view of a sailing craft with a pivotal centerboard to which there is affixed the supplemental propulsion device of the present invention with the centerboard being reciprocated or pumped by a sailor;

FIG. 2 is a perspective view of the propulsion device of the invention before the device is mounted to the leading edge of a centerboard of a sailing craft;

FIG. 3 is an enlarged section view of the centerboard of the sailing craft of FIG. 1 taken on line 3—3 thereof with the wings of the propulsion device of the invention positioned inwardly adjacent the sides of the centerboard; and FIG. 4 is an enlarged section view of the centerboard of the sailing craft of FIG. 1 taken on line 3—3 thereof with the wings of the propulsion device of the invention positioned outwardly from the sides of the centerboard.

DETAILED DESCRIPTION OF THE PREFERRED EMBODIMENTS

Referring initially to FIG. 1 there is illustrated a small sailing craft 10 with shallow draft. The craft 10 is comprised basically of a boat hull 12 having a forward or bow end 14 and a rear or stern end 16. A mast 18 projects upwardly from the hull and bears by well known means a horizontal boom 20. A simple triangular canvas sail 22 is affixed by well known and appropriate means to the mast and boom. The sailing craft 10 is provided with a centerboard 24 which extends downwardly through a central elongated hull slot 26 (terminates at a forward end **26*a* and at a rearward end 26*b*) and which during normal wind sailing periods is fixed in vertical orientation with respect to the hull. The centerboard 24** provides stabilization of the craft under sail against sudden or radical side listing or tilting caused by heavy wind force against the sail or by heavy wave motion against the craft's hull.

The centerboard 24, when released from its fixed wind sailing orientation, is pivotal with respect to the hull 12 at pivot point 28. Affixed to the centerboard 24 is a supplemental propulsion device 30 in accordance with the invention. The propulsion device 30 is mounted to the leading edge **24*a* of the centerboard. As shown in the perspective drawing view of FIG. 2 the propulsion device 30 is comprised of two force wings 32***a* and 32*b* which are Joined at their leading edge portions 32*c* and 32*d*, respectively, to an elongated hinge 34 having hinge leaves 34*a* and 34*b*. The hinge 34 is provided with upper and lower mounting eyelets 34*c* and 34*d*, respectively, which receive mounting screws 36*a* and 36*b*, respectively, that are driven into the leading edge of centerboard 24 to mount the propulsion device 30 thereto.

The force wings 32*a* and 32*b* are connected at their trailing edges by cable 38 which limits the degree to which such wings may spread during the push or thrust portion of each reciprocating cycle of the centerboard during use of the propulsion device 30. Cable guide bracket 40 is mounted to the trailing edge of the centerboard by bolt means 40*a* (see FIGS. 3 and 4) and presents a bracket eyelet 40*b* through which cable 38 passes.

Affixed to the upper corner of the trailing edge of force wings 32*a* and 32*b* are wing lock brackets 42*a* and 42*b*, respectively. With the force wings 32*a* and 32*b* in their closed position adjacent the centerboard 24 (see FIG. 3) during periods within which the propulsion device is not being used the lock portions 42*c* and 42*d*, respectively, of lock brackets 42*a* and 42*b* overlap with their respective lock holes 42*e* and 42*f* coming into alignment so as to receive a locking rod 44 (see FIG. 1). The locking rod 44 extends downwardly along the centerboard's trailing edge from an upper lock bracket 46 affixed to the upper portion of the centerboard. The centerboard 24 is provided with a handle 48 for pumping or reciprocating the centerboard when the propulsion device 30 has been unlocked (locking rod 44 removed from brackets 42*a* and 42*b* of device 30 and upper lock bracket 46) and is to be used. As shown in FIG. 1, the sailor has straddled the centerboard and is facing the bow 14 of the sailing craft 10. In such position, the sailor in pulling handle 48 rearwardly moves the underwater portion of the centerboard 24 forewardly with the surrounding water causing the force wings 32*a* and 32*b* into their closed position (FIG. 3) adjacent the centerboard. When the sailor begins to push handle 48 forwardly during the pumping or reciprocating cycle the underwater portion of the centerboard 30 moves rearwardly with the surrounding water causing the force wings 32*a* and 32*b* to open to the extent permitted by cable 38 with the wings acting as paddle surfaces to propel the craft forwardly. The cable 38 is desirably of a length such that the wings 32*a* and 32*b* never are permitted to extend to near 90° of angulation with respect to the centerboard so that they always move back to their position adJacent to the centerboard after the craft propelling portion of the pumping or reciprocating cycle of the centerboard.

It is to be noted that the centerboard handle 48, for pumping such board and the propulsion device 30 of the invention, may be located at a forward position on the centerboard so that the sailor may sit in a reversed orientation with his or her pulling action (rather than a pushing action) comprising the craft propelling portion of the pumping or reciprocating cycle.

The above described embodiments of the supplemental propulsion device of the invention is easily assembled and mounted to the centerboard of small sailboats or to sailboards. While the present invention has been described with reference to preferred embodiments thereof, it is obvious that modifications and alterations of such embodiment will occur to others skilled in the art upon their reading and understanding of this specification. It is therefore to be understood that the present invention includes all such modifications and alterations, and equivalents thereof, being only limited by the scope of the following claims.

What I claim is:

1. A supplemental propulsion device for a sailboat or sailboard type water craft having a pivotal centerboard extending downwardly from the hull of the craft through an elongated hull slot, said propulsion device comprising: a pair of propulsion wings vertically hinged to one-another by a wing hinge, said wing hinge being mounted to the lower portion of the leading edge of the centerboard of said craft whereby upon the application to the centerboard of a reciprocating pumping action each propulsion wing moves inwardly to a retracted position adjacent the centerboard during forward movement of the lower portion of the centerboard and moves outwardly to an extended position removed from the centerboard during rearward movement of the lower portion of the centerboard; cable means connecting the free edge of said propulsion wings to the trailing edge of the centerboard and of a length to stop the outwardly movement of said wings at a point no more than 90 degrees from the centerboard during rearward movement of the lower portion of the centerboard whereby said wings provide enlarged and effective thrust surfaces to the surrounding water to forcefully propel said craft through the water; handle means at the upper portion of said centerboard for use by a sailor to pump said centerboard and thereby reciprocate said propulsion wings; and means at the free edges of the propulsion wings to lock said wings in their retracted position adjacent the centerboard when the water craft is under sailing propulsion and the supplemental propulsion device is not to be used.

2. A supplemental propulsion device for a sailboat or sailboard type water craft including a pivotal centerboard having a lower portion extending downwardly from the hull of the craft through an elongated hull slot and having an upper portion extending upwardly from the hull slot, said propulsion device comprising: a pair of propulsion wings vertically hinged to one-another by a wing hinge, said wing hinge being mounted vertically to the lower portion of the leading edge of the lower portion of the centerboard of said craft whereby upon the application to the upper portion of the centerboard of a reciprocating pumping action each propulsion wing moves inwardly to a retracted position adjacent the centerboard during forward movement of the lower portion of the centerboard and moves outwardly to an extended position removed from the centerboard during rearward movement of the lower portion of the centerboard; cable means connecting the free edge of said propulsion wings to the trailing edge of the centerboard to stop the outwardly movement of said wings at a point no more than 90 degrees from the centerboard during rearward movement of the lower portion of the centerboard whereby said wings provide enlarged and effective thrust surfaces to the surrounding water to forcefully propel said craft through the water; handle means associated with the upper portion of said centerboard for use by a sailor to pump said centerboard and thereby reciprocate said propulsion wings between their retracted position and their extended position; and locking means at the free edges of said propulsion wings to maintain said wings in their retracted position adjacent the centerboard when the water craft is under sailing propulsion and the supplemental propulsion device is not to be used.

* * * * *